US005429152A

United States Patent [19]

Van Straaten et al.

[11] Patent Number: 5,429,152

[45] Date of Patent: Jul. 4, 1995

[54] CAP FOR GAS CYLINDER

[75] Inventors: Jerome Van Straaten, Saint Mande; Gerard Lhomer, Le Mesnil Saint Denis, both of France

[73] Assignee: L'Air Liquide, Societe Anonyme pour l'Etude et l'Exploitation des Procedes George Claude, Paris, France

[21] Appl. No.: 253,176

[22] Filed: Jun. 2, 1994

[30] Foreign Application Priority Data

Jun. 3, 1993 [FR] France ..... 93 06644

[51] Int. Cl.[6] ..... B65D 51/24

[52] U.S. Cl. ..... 137/377; 137/382; 220/724; 220/726

[58] Field of Search ..... 137/377, 382, 382.5; 220/724, 725, 726, 727, 426, 356; 222/182, 192

[56] References Cited

U.S. PATENT DOCUMENTS

| | | | |
|---|---|---|---|
| 1,751,435 | 3/1930 | Zenner | 220/724 |
| 3,970,284 | 7/1976 | Cobbe, Jr. | 251/149.9 |
| 4,724,833 | 2/1988 | Bartos . | |
| 4,967,923 | 11/1990 | Wren | 137/382 X |
| 5,004,117 | 4/1991 | Kitsuda | 137/382 X |
| 5,261,559 | 11/1993 | Salvucci, Sr. | 137/382 X |

FOREIGN PATENT DOCUMENTS

| | | |
|---|---|---|
| 0303840 | 2/1989 | European Pat. Off. . |
| WO91/04197 | 4/1991 | WIPO . |

*Primary Examiner*—Martin P. Schwadron
*Assistant Examiner*—Kevin L. Lee
*Attorney, Agent, or Firm*—Young & Thompson

[57] ABSTRACT

A cap for a cylinder of gas comprising a lower portion (2) adapted to be mounted on a gas cylinder (3) and an upper portion (1) defining internally a space (20-19) protecting a gas distribution valve structure (4) secured to the cylinder. The lower portion (2) comprises a portion (8) that projects laterally relative to the cylinder and comprises a downwardly opening cut out (12) permitting the support by hooking of the cap/cylinder assembly on a structural support element. The projecting portion (8) has a transverse external profile which is flat or of large radius of curvature permitting supporting on a flat surface the cap/cylinder assembly. The upper portion (1) comprises a transverse handle (22) in substantially vertical alignment with the laterally projecting portion (8). The upper portion (1) comprises two lateral vertical ribs (23A, 23B) connecting the handle (22) to the projecting portion (8). The cap/cylinder assembly is useful particularly for medical oxygen.

10 Claims, 2 Drawing Sheets

CAP FOR GAS CYLINDER

FIELD OF THE INVENTION

The invention relates to caps for gas cylinders comprising a lower portion adapted to be mounted on a gas cylinder and an upper portion defining internally a space shielding a valve structure for distribution of gas, secured to the cylinder.

BACKGROUND OF THE INVENTION

For a long time, caps of gas cylinders have been constituted by a metallic member which is a body of revolution flaring progressively from the lower part to the end of the upper part forming the handling loop, to which the name "tulip" is generally given in French. These known caps do not permit manipulation much less easy handling of the gas cylinder.

SUMMARY OF THE INVENTION

The present invention has for its object to provide an improved cap, suitable more particularly to portable gas cylinders, particularly of medical oxygen, greatly facilitating the retention and handling of the cylinder and offering new functional possibilities, particularly for support by hooking and immobilization in one plane of the cylinder provided with such a cap, and moreover imparting improved protection to the distribution valve structure shielded by the cap.

To do this, according to a characteristic of the invention, the lower portion of the cap comprises a portion that projects laterally relative to the master coupling of the cylinder and comprising a downwardly opening cut out permitting support by hooking of the cap/cylinder assembly on a structural support element.

According to other characteristics of the invention:

- the laterally projecting portion has an external transverse profile of large radius of curvature or substantially flat, permitting the flat support of the cap/cylinder assembly on a surface and avoiding that this latter will roll on said surface;
- the upper part comprises a transverse handle for carrying and handling, extending substantially directly above the portion that laterally projects;
- the upper and lower portions are constituted by two individual members, respectively upper and lower, assembled with each other and preferably made of plastic material.

BRIEF DESCRIPTION OF THE DRAWINGS

Other characteristics and advantages of the present invention will become apparent from the following description of one embodiment, given by way of illustration but in no way limiting, with respect to the accompanying drawings, in which.

DETAILED DESCRIPTION OF THE INVENTION

Figure 1:
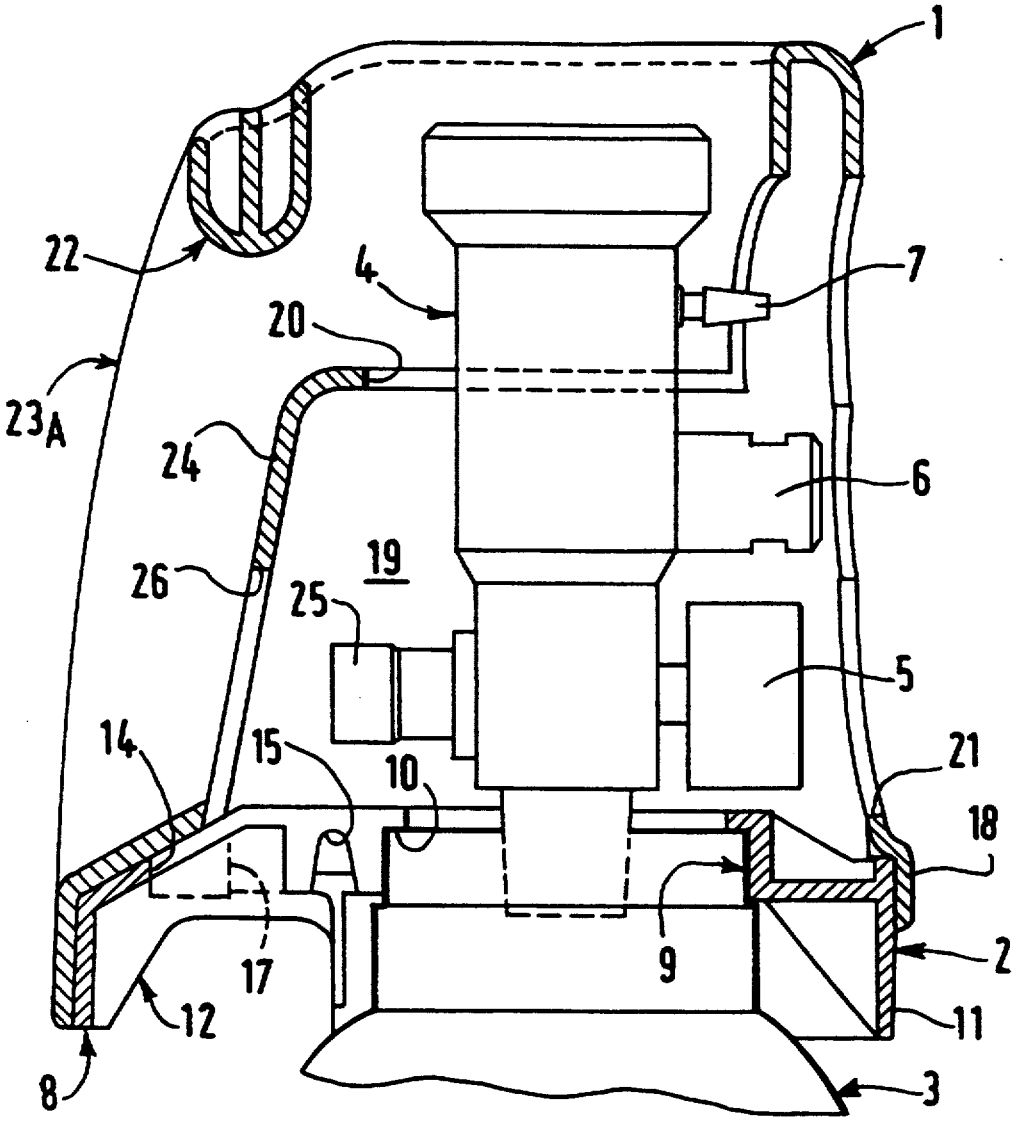
- FIG. 1 is a schematic vertical cross sectional view of a cap according to the invention mounted on a gas cylinder provided with a gas distribution valve structure.

As is seen in FIG. 1, the cap of the gas bottle according to the invention comprises essentially a member or upper portion 1 mounted on a member or lower portion 2, itself mounted on the neck of a gas cylinder 3, for example a small cylinder of medical oxygen, provided with a gas distribution valve structure 4, preferably of the type disclosed in French patent application FR 93.06646 comprising, on the one hand, a manometer 5, a medium pressure gas outlet 6 and a low pressure gas outlet 7 supplying a flow rate modulated by a flow rate regulating device disposed at the end of the valve structure 4.

Figure 4:
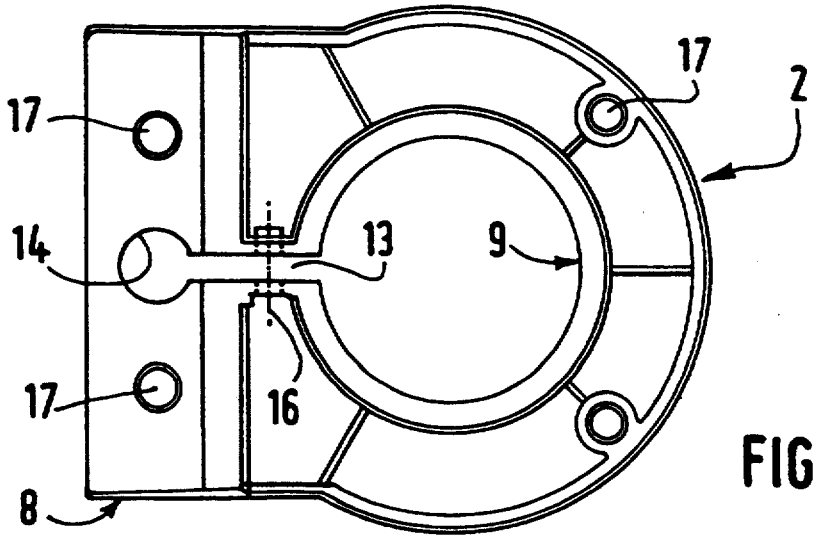
- FIG. 4 is a view from above of the lower portion of the cap of FIG. 1.

The lower portion 2 has, as is better seen in FIG. 4, a configuration generally of cylindrical shape with a portion 8 of generally quadrangular shape and projecting laterally relative to the master coupling or to the cylinder 3. The lower portion 2 comprises a stepped central recess 9 forming an internal shoulder 10 and adapted to receive the upper portion of the neck of the cylinder 3, and a downwardly extending peripheral shield 11 protecting the neck of the cylinder. According to one aspect of the invention, the peripheral shield 11 comprises, at the level of the projecting portion 8, two lateral confronting cut outs 12 opening downward thus providing, on one side of the cylinder, a recess permitting hooking the cap/cylinder assembly on a bar, for example a side bar of a bed, or on a rod, for example in an ambulance. In the illustrated embodiment, a vertical slot 13 connects the stepped recess 9 to a cut out 14 formed in the upper wall of the member 2, cut outs or openings 15 being provided confrontingly, on opposite sides of the slot 13, for the passage of a locking screw, shown at 16 in FIG. 4 and permitting gripping the recess 9 about the neck of the cylinder 3 before securement of the cap on this latter. In the illustrated embodiment, the lower member 2 also comprises a series (in this case four in FIG. 4), of vertical channels 17 adapted to receive lugs projecting downwardly from the upper portion 1 for the securement, by screwing, of this latter on the lower portion 2.

Figure 2:
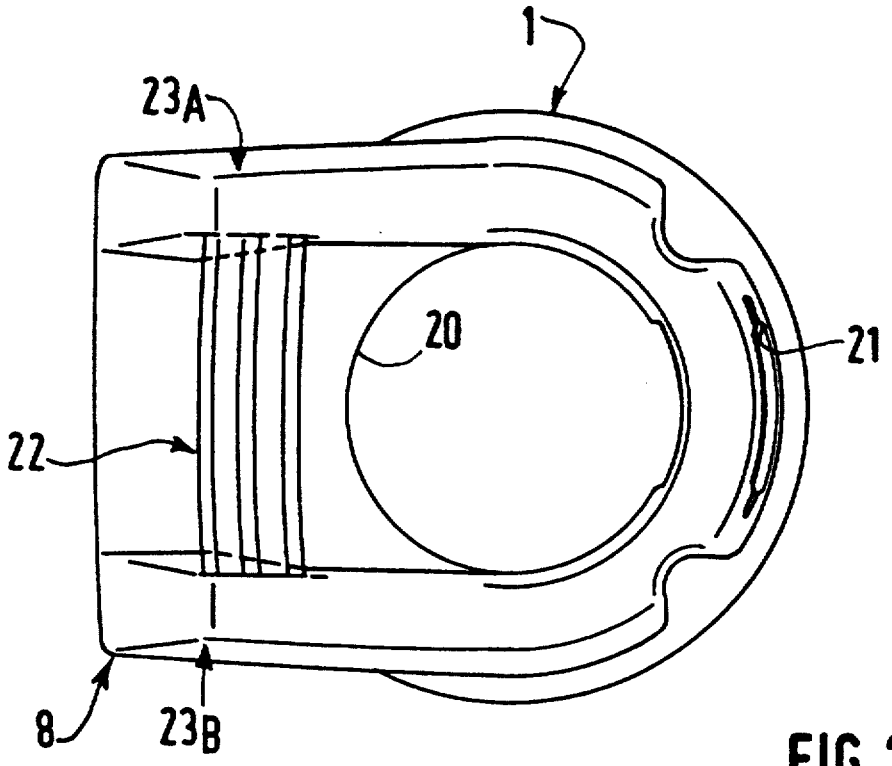
- FIGS. 2 and 3 are views respectively from above and from the rear of the cap of FIG. 1.
Figure 3:
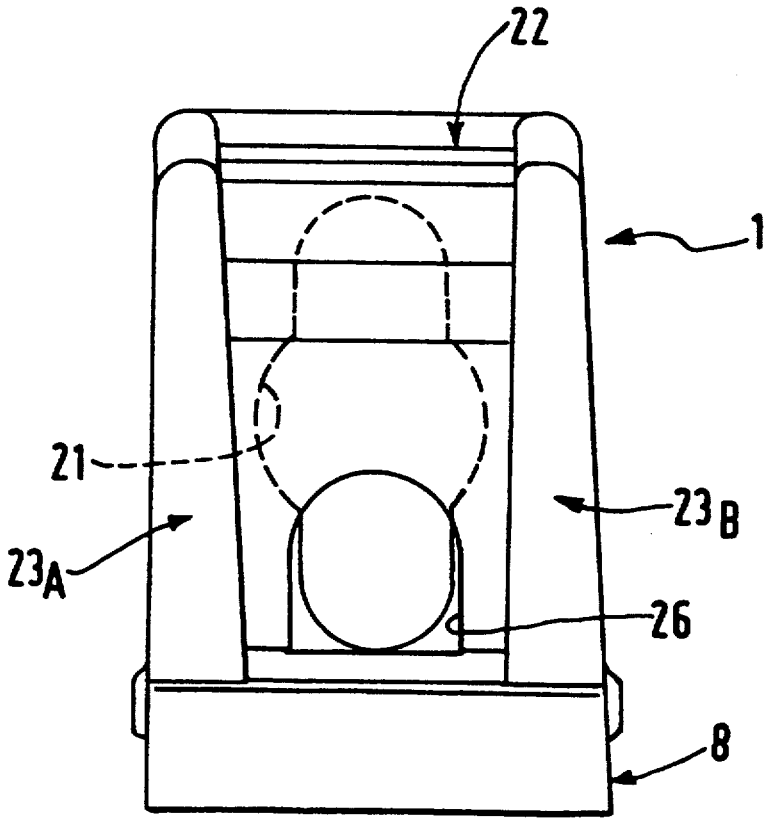

As is seen in FIGS. 1 to 3, the upper portion 1 comprises a lower downwardly extending shield 18 shaped to receive the upper ends of the lower portion 2, including the protecting portion 8 of this latter. The upper portion 1 forms a shell structure defining an internal space 19 shielding the structure of valve 4 whose upper portion extends into a central cylindrical passage 20 of the shell, as is best seen in FIGS. 1 and 2. The side wall by the upper portion 1 has a shaped cut out 21 giving access to the couplings 7 and 6 and permitting reading of the manometer 5.

According to one aspect of the invention, the upper portion 1 comprises, in its upper region, a transverse handle 22 parallel to the principal axis of the hooking cut out 12, substantially vertically aligned with this latter. The sides of the handle 22 are connected to the portion of the lower skirt 18 overlying the corresponding portion of the skirt 11 of the lower portion defining the cut outs 12 by two strong vertically extending lateral ribs 23A, 23B, these ribs 23 being interconnected transversely by an internal shield portion 24 extending inwardly away from the ribs and delimiting laterally, toward the rear, the internal space 19 opposite the cut out 21. In the case in which the structure of the valve 4 comprises, opposite the manometer 5, a coupling 25 for filling the cylinder 3, the shield 24 comprises a cut out 26 facing the coupling 25.

As is best seen in FIGS. 2 and 4, the laterally projecting portion 8 defining the hooking cut outs 12 has an external configuration which is substantially straight or, to facilitate molding, with a large radius of curvature. The laterally projecting portion 8 thus defines a lower edge, extending outside the master coupling of the cylinder 3 and thus permitting positioning the assembly of the cap 1, 2 and of the cylinder 3 on a flat surface, by bearing on this edge, with the active elements 5–7 maintained vertically above, so that the cylinder cannot roll on the support surface, which has an advantage for example during emergency administration of oxygen to wounded persons or for welding/cutting operations in situ, the cylinder then containing a welding or protective gas for welding/cutting.

Preferably, each of the upper and lower members 1 and 2 is formed from a single piece by molding a thermoplastic material, for example a copolymer of polypropylene-polyethylene having adequate mechanical resistance and elasticity.

Although the present invention has been described in connection with a particular embodiment, it is not thereby limited but is on the contrary susceptible to modifications and variations which will be apparent to those skilled in the art.

What is claimed is:

1. A cap for a gas cylinder comprising a main portion having a nominal diameter and an end portion of reduced diameter carrying a gas distribution valve means, the cap further comprising a lower part adapted to be mounted on a neck portion of the gas cylinder and an upper part defining an inner space for housing the gas distribution valve means, wherein the lower part comprises a portion that projects outwardly beyond the nominal diameter of the cylinder and is formed with a transversely extending downwardly opening recess permitting to hookingly suspend the cap/cylinder assembly on a support element.

2. A cap according to claim 1, wherein said projecting portion has a transverse external profile of large radius of curvature, thereby permitting to lay flat in a stable manner the cap/cylinder assembly onto a surface.

3. A cap according to claim 2, wherein said upper portion comprises a handle in substantially vertical alignment with the laterally projecting portion of the lower part.

4. A cap according to claim 1, wherein said upper and lower portions are constituted respectively of two individual members assembled with each other.

5. A cap according to claim 4, wherein said lower member comprises means for gripping attachment to the neck portion of the gas cylinder.

6. A cap according to claim 4, wherein at least one of said two members is made of plastic material.

7. A cap according to claim 1 wherein said gas cylinder contains oxygen under pressure.

8. A cap for a gas cylinder comprising a lower portion adapted to be mounted on a gas cylinder and an upper portion defining internally a space protecting a gas distribution valve structure secured to the cylinder, said lower portion comprising a portion that projects laterally relative to the cylinder and comprises a downwardly opening cutout permitting the support by hooking of the cap/cylinder assembly on a structural support element, and said upper portion comprising a transverse handle in substantially vertical alignment with the laterally projecting portion and two lateral vertical ribs connecting the handle to the projecting portion.

9. A cap according to claim 8, wherein the two ribs are interconnected transversely by a portion of skirt inclined upwardly inwardly relative to the ribs.

10. A cap according to claim 8 wherein said gas cylinder contains oxygen under pressure.

* * * * *